US007836961B2

(12) United States Patent
Li et al.

(10) Patent No.: US 7,836,961 B2
(45) Date of Patent: Nov. 23, 2010

(54) INTEGRATED HYDRAULIC SETTING AND HYDROSTATIC SETTING MECHANISM

(75) Inventors: Haoming Li, Missouri City, TX (US); Bryan Burwell, Angleton, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 269 days.

(21) Appl. No.: 12/042,893

(22) Filed: Mar. 5, 2008

(65) Prior Publication Data

US 2009/0223675 A1 Sep. 10, 2009

(51) Int. Cl.
*E21B 33/1295* (2006.01)
*E21B 34/10* (2006.01)

(52) U.S. Cl. ..... 166/387; 166/374; 166/151; 166/185

(58) Field of Classification Search ..... 166/381, 166/374, 185, 151, 152, 387
See application file for complete search history.

(56) References Cited

U.S. PATENT DOCUMENTS

| | | | | |
|---|---|---|---|---|
| 3,503,445 | A * | 3/1970 | Cochrum et al. | 166/244.1 |
| 4,856,595 | A * | 8/1989 | Upchurch | 166/374 |
| 5,332,038 | A | 7/1994 | Tapp et al. | |
| 5,615,741 | A * | 4/1997 | Coronado | 166/387 |
| 5,810,082 | A | 9/1998 | Jordan, Jr. | |
| 5,887,654 | A | 3/1999 | Edwards et al. | |
| 5,893,413 | A | 4/1999 | Lembcke et al. | |
| 6,213,203 | B1 | 4/2001 | Edwards et al. | |
| 6,315,050 | B2 * | 11/2001 | Vaynshteyn et al. | 166/376 |
| 6,349,772 | B2 * | 2/2002 | Mullen et al. | 166/387 |
| 6,354,374 | B1 | 3/2002 | Edwards et al. | |
| 6,684,950 | B2 | 2/2004 | Patel | |
| 7,172,029 | B2 | 2/2007 | Hirth et al. | |
| 7,337,850 | B2 | 3/2008 | Contant | |
| 7,562,712 | B2 * | 7/2009 | Cho et al. | 166/319 |
| 7,717,183 | B2 * | 5/2010 | Ezell et al. | 166/373 |
| 2001/0013415 | A1 * | 8/2001 | Mullen et al. | 166/374 |
| 2005/0072575 | A1 * | 4/2005 | Yeo et al. | 166/374 |
| 2007/0246227 | A1 * | 10/2007 | Ezell et al. | 166/387 |
| 2009/0229832 | A1 * | 9/2009 | King | 166/373 |
| 2009/0288838 | A1 * | 11/2009 | Richards | 166/374 |

FOREIGN PATENT DOCUMENTS

| | | | |
|---|---|---|---|
| GB | 2372770 | A | 9/2002 |
| GB | 2412133 | A | 9/2005 |

* cited by examiner

*Primary Examiner*—Jennifer H Gay
(74) *Attorney, Agent, or Firm*—Rodney V. Warfford; Kevin B. McGoff; Tim Curington

(57) ABSTRACT

A tool includes an integrated hydraulic setting and hydrostatic setting mechanism that has a first part responsive to hydraulic pressure applied through a conduit, and a second part responsive to hydrostatic pressure. An activatable element can be activated by the integrated hydraulic setting and hydrostatic setting mechanism.

23 Claims, 2 Drawing Sheets

INTEGRATED HYDRAULIC SETTING AND HYDROSTATIC SETTING MECHANISM

TECHNICAL FIELD

The invention relates to an integrated hydraulic setting and hydrostatic setting mechanism for activating an element in a wellbore.

BACKGROUND

In completing various operations in a well, different types of elements are activated. In many instances, such activatable elements are activated by fluid pressure, which can be in the form of hydrostatic pressure or hydraulic pressure. Hydrostatic pressure refers to pressure created by a column of fluid in a wellbore at any given depth of the wellbore. Hydraulic pressure refers to pressure applied through some conduit that is run into the wellbore.

One type of activatable element that can be deployed in a wellbore is a packer, which includes a sealing element that seals against an inner wall of the wellbore to isolate a particular zone of the wellbore. Traditionally, packers have been set mostly by using a hydraulic setting mechanism. However, a trend that has developed is that it is desirable to set packers using a hydrostatic mechanism, since a hydrostatic mechanism will eliminate or reduce well intervention during the packer setting stage. Since many existing designs of packers include a hydraulic setting mechanism, one conventional approach that has been used is to provide an add-on hydrostatic setting module, which is coupled to the packer. However, the use of such an add-on hydrostatic setting module adds to the overall length of the packer as well as to the cost of the packer.

SUMMARY

In general, according to an embodiment, an apparatus for use in a wellbore includes an integrated hydraulic setting and hydrostatic setting mechanism that has a first part responsive to hydraulic pressure applied through a conduit, and a second part responsive to hydrostatic pressure. An activatable element can be activated by the integrated hydraulic setting and hydrostatic setting mechanism.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
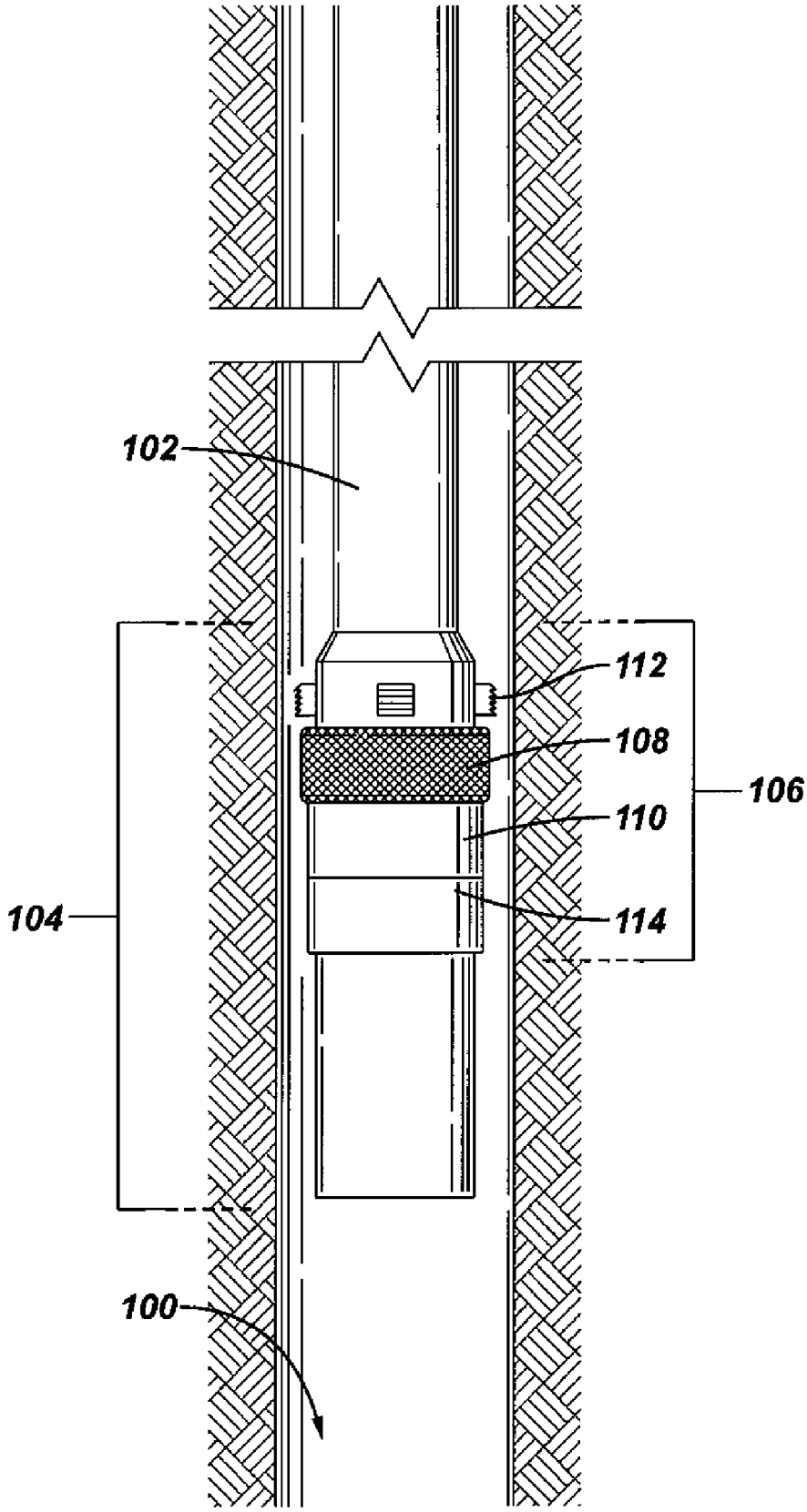
FIG. 1 illustrates an example tool string that incorporates an integrated hydraulic setting and hydrostatic setting mechanism according to an embodiment.

FIG. 1 illustrates an example tool string that has been deployed into a wellbore 100. The wellbore 100 may be lined with a casing or liner, or alternatively, the wellbore 100 can be an open wellbore that is unlined. The tool string includes a carrier structure 102 for carrying a tool 104 that is lowered into the wellbore 100. In the depicted example, the tool 104 includes a packer 106. Although reference is made to a packer as being an example, it is noted that in other implementations, other types of activatable elements can be used with some embodiments of the invention. Examples of such other activatable elements include flow control devices, perforating guns, and so forth.

An example of the carrier structure 102 is a tubing, such as jointed tubing. Other types of the carrier structure 102 can be used in other implementations, such as coiled tubing, drill pipes, and so forth.

The packer 106 has a sealing element 108 that is moveable outwardly in a radial direction by application of a force by an actuating member 110 of the packer 106. The sealing element 108 is engageable with an inner surface of the wellbore (e.g., inner wall of a casing or liner, or open surface of the wellbore). The sealing element 108 engages the inner surface of the wellbore 100 to provide a seal such that one zone of the wellbore 100 is isolated from another zone of the wellbore 100. The packer 106 also includes one or more anchoring slips 112 that are moveable radially outwardly to engage the inner surface of the wellbore 100 to anchor the packer 106 in position in the wellbore 100.

The actuating member 110 is moveable by an integrated hydraulic setting and hydrostatic setting mechanism 114 that is part of the packer 106. The integrated hydraulic setting and hydrostatic setting mechanism includes a first part ("hydraulic setting part") that is responsive to hydraulic pressure applied through a conduit (e.g., inner bore of the tubing 102), and a second part ("hydrostatic setting part") that is responsive to hydrostatic pressure that is present in the wellbore 100 outside the packer 106. Either the first part or second part of the integrated hydraulic setting and hydrostatic setting mechanism can be used to set the packer 106. By integrating the hydraulic setting part and hydrostatic setting part into a single mechanism 114, both hydraulic setting and hydrostatic setting capabilities can be provided in the packer 106 without adding any significant length or cost to the packer 106. This is contrasted to conventional packers where an add-on module has to be provided to allow for addition of a hydrostatic setting mechanism, for example. The conventional add-on module increases the overall length of the tool that is deployed into the wellbore, and adds to the overall cost.

As used here, a hydraulic setting mechanism and hydrostatic setting mechanism are considered to be "integrated" if they are formed to be part of the same device, such as the packer 106, in contrast to conventional devices in which the hydraulic setting mechanism and hydrostatic setting mechanism are part of different modules that are connected or coupled together.

A feature of some embodiments of the integrated hydraulic setting and hydrostatic setting mechanism 114 is that a separate control line does not have to be provided in the tool string to provide hydraulic activation. In the implementation of FIG. 1, the hydraulic pressure can be communicated through the inner bore of the tubing 102 to apply the hydraulic pressure to the integrated hydraulic setting and hydrostatic setting mechanism. Omitting a control line reduces complexity of the tool string and thus overall cost. Omitting a control line also allows a packer without a control line to use a hydrostatic setting technique. However, in other implementations, it is noted that a control line can be used to apply hydraulic pressure to the integrated hydraulic setting and hydrostatic setting mechanism.

Moreover, flexibility is provided to allow a well operator to decide whether both hydrostatic setting and hydraulic setting features are to be provided in the mechanism 114. If the well operator decides that hydraulic or hydrostatic setting is undesirable, then that particular feature can be easily disabled in the mechanism 114 without affecting the interface with other downhole tools. The decision to disable a particular setting mechanism can be made at the rig (well site) such that flexibility is enhanced.

Figure 2:
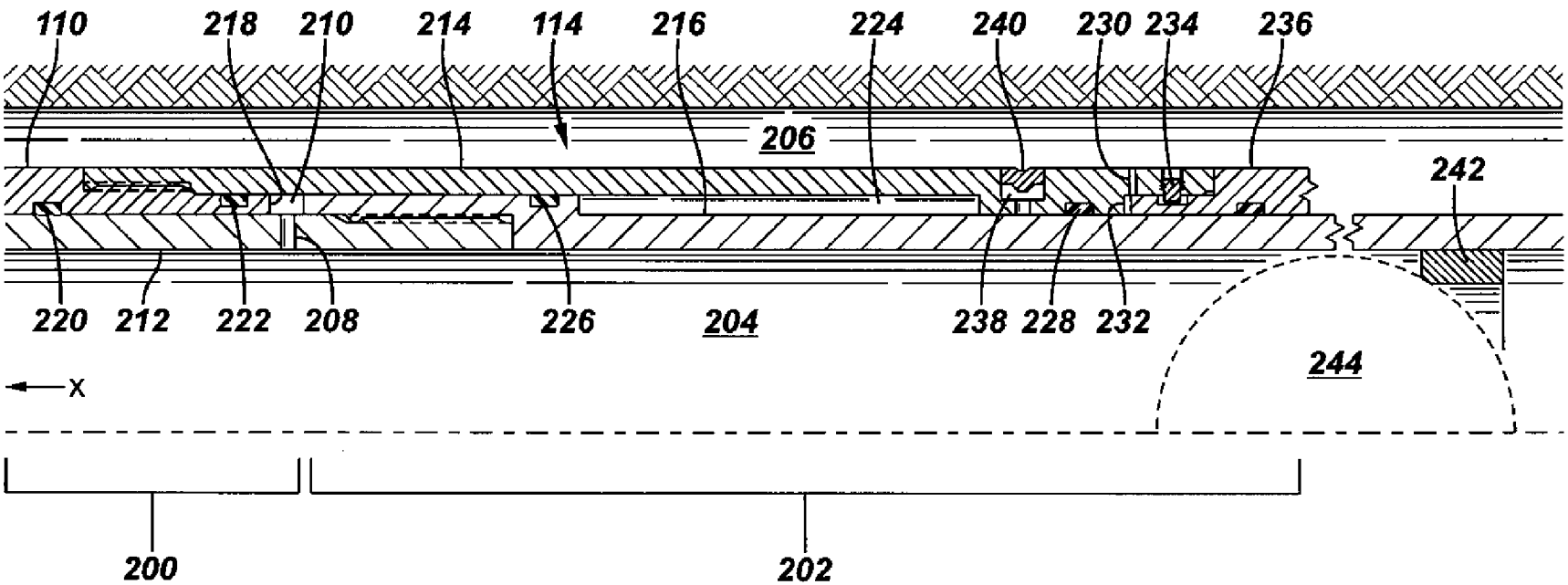
FIG. 2 is a cross-sectional view of a section of the integrated hydraulic setting and hydrostatic setting mechanism.

FIG. 2 illustrates an example section of the integrated hydraulic setting and hydrostatic setting mechanism 114. The integrated hydraulic setting and hydrostatic setting mechanism 114 has a hydraulic setting part 200 that is responsive to applied hydraulic pressure in an inner bore 204 of the tool 104, and a hydrostatic setting part 202 that is responsive to hydrostatic pressure applied in a wellbore region 206 outside the integrated hydraulic setting and hydrostatic setting mechanism 114.

The hydraulic setting part 200 includes the actuation member 110 (moveable in a longitudinal direction of the packer 106), which applies the force against the sealing element 108 and anchoring slip 112 for setting the packer 106. Although the sealing element and slip are both above the setting mechanism in FIG. 1, they can be on the other side or either side of the setting mechanism in other implementations. Although reference is made to "actuation member" in the singular sense, note that the actuation member can actually be made up of multiple pieces that are attached together.

The hydraulic setting part 200 also includes an inner radial port 208 that extends between the inner bore 204 and an inner chamber 210. The inner chamber 210 is defined by a first packer inner mandrel 212, a second actuating member 214, and a second packer inner mandrel 216.

A lower surface 218 of the first actuating member 110 is exposed to the chamber 210 such that any pressure applied in the inner chamber 210 acts against the surface 218 for moving the first actuating member 110 in an upward direction, indicated by arrow x in FIG. 2.

The first actuation member 110 is fixedly connected to the second actuation member 214, such that the first and second actuation members 110, 214 are configured to move together in response to applied pressure (either hydraulic pressure applied to the inner chamber 210 or hydrostatic pressure applied in the wellbore region 206). In the example of FIG. 2, the first actuation member 110 is threadably connected to the second actuation member 214. In other embodiments, other types of attachment mechanisms can be used between the first and second actuation members 110 and 214. Alternatively, instead of directly attaching the actuation member 110 to the actuation member 214, it is noted that an intermediate connecting member (or multiple intermediate connecting members) can be provided to attach the first actuation member 110 to the second actuation member 214. More generally, the first actuation member 110 and second actuation member 214 are said to be cooperatively attached, so that the two actuation members are moved together in response to applied hydraulic or hydrostatic pressure.

As depicted in FIG. 2, an O-ring seal 220 is provided between the first actuation member 110 and the first packer inner mandrel 212, and another O-ring seal 222 is provided between the first actuation member 110 and the second actuation member 214. The O-ring seals 220, 222 and seal ball/plug 244 are provided to isolate the inner chamber 210 from the outside wellbore region 206.

Note that the hydraulic pressure applied into the inner chamber 210 acts on the first actuation member 110 against the hydrostatic pressure that is present in the wellbore region 206 (in other words, a differential pressure is applied across the first actuation member 110). Thus, the applied hydraulic pressure into the chamber 210 has to apply a force greater than the counteracting force applied by the hydrostatic pressure in the wellbore region 206 to cause movement of the first actuation member 110 in direction x.

The second actuation member 214 is part of the hydrostatic setting part 202 of the integrated hydraulic setting and hydrostatic setting mechanism 114. In the hydrostatic setting part 202, an atmospheric chamber (or low pressure chamber) 224 is defined between the second actuation member 214 and the second packer inner mandrel 216. Note that O-ring seals 226 and 228 are provided proximate the two ends of the atmospheric chamber 224 to seal the atmospheric chamber 224 (such that the atmospheric chamber 224 is isolated from fluids in the wellbore region 206 and inner bore 204 if the seals are working properly). The atmospheric chamber (or low pressure chamber) 224 contains air (compressible gas) that is at a relatively low pressure (e.g., atmospheric pressure since the tool is made up at the earth surface) such that presence of a hydrostatic pressure in the wellbore 100 can create a differential pressure.

The hydrostatic setting part 202 also includes an outer radial port 230 defined in the second actuation member 214 to allow hydrostatic pressure in the wellbore region 206 to be communicated to a lower surface 232 of the second actuation member 214. The pressure in the wellbore region 206 thus acts against the surface 232 of the second actuation member 214. In other implementations, the radial port 230 can be omitted, since the shoulder at 236 and shoulder at 232 can function as piston area if 230 is not there.

The second actuation member 214 is initially fixed in position by a shear element 234, which attaches the second actuation member 214 to a housing member 236 of the packer 106. The shear element 234 can be a shear screw, shear pin, and so forth. If a sufficient pressure is present in the wellbore region 206 (such that a differential pressure between the wellbore region 206 and atmospheric chamber 224 of greater than a threshold is present), then the shear element 234 is sheared so that movement of the second actuation member 214 in direction x is possible. Instead of shear element 234, a rupture disk or any other similar device can be used, so that once the pressure is high enough to open the device, wellbore pressure will act on the piston area to set the element.

Another feature of the integrated hydraulic setting and hydrostatic setting mechanism 114 is a rupture element 238 that is provided in a recess 240 of the second actuation member 214. The rupture element 238 has a first side exposed to pressure in the wellbore region 206, and a second side exposed to pressure in the atmospheric chamber 224. As will be discussed further below, this rupture element 238 is configured to be inversely ruptured by elevated pressure in the atmospheric chamber 224 in the scenario where leakage has caused fluid communication between the atmospheric chamber 224 and the inner bore 204 of the integrated hydraulic setting and hydrostatic setting mechanism 114. The rupture element also has two other functions: (1) to act as a plug to seal the low-pressure chamber 224 from the wellbore; and (2) to rupture externally once the mechanism is set so as to add strength to the mandrel 216.

FIG. 2 also shows that the integrated hydraulic setting and hydrostatic setting mechanism 114 has a ball catch member 242 that protrudes inwardly into the inner bore 204 from the packer inner mandrel 216. The ball-catch member 242 is designed to catch a ball 244 that is dropped into the integrated hydraulic setting and hydrostatic setting mechanism 114 (the ball can be dropped from the earth surface through the tool string) to enable application of hydraulic pressure in the inner bore 204 to cause actuation of the packer 106. When the ball 244 is engaged with the ball-catch member, a fluidic seal is provided such that hydraulic pressure can be increased in the inner bore 204 above the ball 244. In an alternative implementation, another type of plug can be dropped into the mechanism 114.

In operation, a tool 104 (FIG. 1) including the packer 106 and other components is run into the wellbore 100 on the carrier structure 102. For purposes of this discussion, it is assumed that the primary activation mechanism of the packer 106 is the hydrostatic setting part 202 of the mechanism 114, while the hydraulic setting part 200 is considered to be the backup setting mechanism. Once the tool 104 is lowered to a desired depth, the packer 106 is ready for setting.

At this depth, a certain hydrostatic pressure is present in the wellbore region 206 outside the packer 106. This hydrostatic pressure is communicated to act on the lower surface 232 of the second actuation member 214. The shear element 234 is designed such that it is intended to shear in the presence of the target hydrostatic pressure (at the target depth to which the tool is to be deployed) plus an additional applied pressure that is applied in the wellbore region 206, whenever needed. Thus, to set the packer 106 using the hydrostatic setting part 202, a well operator will cause an incremental applied pressure to be communicated down the annulus (between the tool string and the inner surface of the wellbore 100) such that a sufficient differential pressure (between the wellbore region 206 and atmospheric chamber 224) is created to apply a force on the second actuation member 214 to shear the shear element 234. As a result, the second actuation member 214 is moved upwardly (in direction x). Since the first actuation member 110 is fixably attached to the second actuation member 214, the first actuation member 110 is also moved upwardly. In response to the force induced by the wellbore region pressure (hydrostatic pressure plus incremental applied pressure), the first actuation member 110 applies the necessary force to set the packer 106.

If it is desired to use the hydraulic setting part 200 instead of the hydrostatic setting part 202 (such as due to failure that caused hydrostatic pressure to be leaked into the atmospheric chamber 224 or for some other reason), a ball 244 (or other plug) is dropped into the inner bore of the carrier structure 102. The ball 244 is caught by the ball-catch member 242 of the integrated hydraulic setting and hydrostatic setting mechanism 114. The ball 244 forms a fluidic seal against the ball-catch member 244. This enables the well operator to elevate the pressure of the inner bore 204 of the integrated hydraulic setting and hydrostatic setting mechanism 114 above the ball 244. The elevated applied pressure in the inner bore 204 is communicated through the inner radial port 208 to the inner chamber 210 of the hydraulic setting part 200 to act on the lower surface 218 of the first actuation member 110. Note that hydrostatic pressure is acting on the other side of the first actuation member 110. If the applied hydraulic pressure in the inner bore 204 is high enough to overcome the hydrostatic pressure, and if such differential pressure is sufficient to overcome the shear strength of the shear element 234, then the shear element 234 will be sheared to allow the applied hydraulic pressure to move the first and the second actuation members 110, 214 in direction x.

In a worst case scenario, after the atmospheric chamber 224 is filled with wellbore fluid because of leakage, the atmospheric chamber 224 becomes sealed again due to debris. Since wellbore fluid is generally dirty (filled with debris), the leak path between the atmospheric chamber 224 and the wellbore region 206 may be blocked by the debris. In such a case, the hydraulic setting part 200 may not work properly because the inner bore 204 pressure would have to work against incompressible fluid trapped in the atmospheric chamber 224. To address this scenario, the rupture element 238 noted above is provided. Due to application of hydraulic pressure in the inner bore 204, the pressure of the incompressible fluid in the atmospheric chamber 224 will build up. At a high enough pressure, the pressure inside the atmospheric chamber 224 will cause an inverse rupture of the rupture element 238 (where an internal elevated pressure ruptures the rupture element 238 from the inside to the outside). When the rupture element 238 ruptures, a fluid path is established between the atmospheric chamber 224 and the wellbore region 206 through the recess 240 of the second actuation member 214. As a result, the atmospheric chamber 224 is brought back to the hydrostatic pressure such that an elevated hydraulic pressure in the inner bore 204 can create the desired differential pressure to move the first and second moveable members 110, 214.

Note that a secondary function of the rupture element 238 is to allow the atmospheric chamber 214 to communicate with the wellbore region 206 after the packer 106 is set. This provides more support for the internal parts of the packer 106 (by avoiding presence of a low-pressure region inside the packer 106 for an extended period of time).

In those cases where it is decided that the hydrostatic setting part 202 of the integrated hydraulic setting and hydrostatic setting mechanism 114 is not needed, then a well operator can remove the rupture element 238. In such a scenario, the atmospheric chamber 224 will be filled with wellbore fluids once the tool is run into the wellbore. This effectively disables the hydrostatic setting feature. In such a configuration, the packer 106 will function as a hydraulic-set-only packer.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a wellbore, comprising:

an integrated hydraulic setting and hydrostatic setting mechanism comprising a first part responsive to hydraulic pressure applied through a conduit, and a second part responsive to hydrostatic pressure in the wellbore, wherein the first part and second part are integrated as part of one device such that the first and second parts are not part of different modules that are connected or coupled together; and an activatable element to be activated by the integrated hydraulic setting and hydrostatic setting mechanism, wherein the second part is responsive to the hydrostatic pressure to activate the activatable element while the first part remains deactivated.

2. The apparatus of claim 1, wherein the first part is responsive to the hydraulic pressure applied through an inner bore of a tool string, wherein the conduit includes the inner bore of the tool string.

3. The apparatus of claim 2, wherein the integrated hydraulic setting and hydrostatic setting mechanism comprises a radial port to receive the hydrostatic pressure from a wellbore region outside the integrated hydraulic setting and hydrostatic setting mechanism.

4. The apparatus of claim 1, wherein the second part of the integrated hydraulic setting and hydrostatic setting mechanism has a low pressure chamber.

5. The apparatus of claim 4, wherein the second part is activated by wellbore pressure that includes the hydrostatic pressure plus an incremental applied pressure.

6. The apparatus of claim 4, wherein the low pressure chamber comprises an atmospheric chamber.

7. The apparatus of claim 4, wherein the integrated hydraulic setting and hydrostatic setting mechanism further comprises a shear element to be sheared by activation of the first part or second part.

8. The apparatus of claim 1, wherein the second part is a primary setting mechanism and the first part is a backup setting mechanism to be used upon failure of the second part.

9. The apparatus of claim 1, wherein the integrated hydraulic setting and hydrostatic setting mechanism further includes a member to receive a plug dropped through the wellbore, wherein engagement of the plug with the member provides a fluidic seal that enables application of the hydraulic pressure inside an inner bore of the integrated hydraulic setting and hydrostatic setting mechanism, wherein the conduit includes the inner bore.

10. The apparatus of claim 1, wherein the activatable element is a packer.

11. An apparatus for use in a wellbore, comprising:

an integrated hydraulic setting and hydrostatic setting mechanism comprising a first part responsive to hydraulic pressure applied through a conduit, and a second part responsive to hydrostatic pressure in the wellbore; and an activatable element to be activated by the integrated hydraulic setting and hydrostatic setting mechanism, wherein the second part is responsive to the hydrostatic pressure to activate the activatable element while the first part remains deactivated, wherein the second part has a first moveable actuation member having a first surface exposed to the hydrostatic pressure, and wherein the first part has a second moveable actuation member in communication with fluid in the conduit, wherein the first and second moveable actuation members are cooperatively attached to each other such that the first and second moveable members move together in response to either the hydraulic or hydrostatic pressure.

12. The apparatus of claim 11, wherein the first moveable actuation member is fixedly connected to the second moveable actuation member.

13. An apparatus for use in a wellbore, comprising:

an integrated hydraulic setting and hydrostatic setting mechanism comprising a first part responsive to hydraulic pressure applied through a conduit, and a second part responsive to hydrostatic pressure in the wellbore;

an activatable element to be activated by the integrated hydraulic setting and hydrostatic setting mechanism, wherein the second part is responsive to the hydrostatic pressure to activate the activatable element while the first part remains deactivated, wherein the second part of the integrated hydraulic setting and hydrostatic setting mechanism has a low pressure chamber, and wherein the integrated hydraulic setting and hydrostatic setting mechanism further comprises a rupture element in fluid communication with the low pressure chamber, wherein the rupture element is rupturable from elevated pressure applied to fluid in the low pressure chamber due to application of the hydraulic pressure in the conduit.

14. The apparatus of claim 13, wherein the rupture element is configured to also be ruptured by elevated pressure in the chamber.

15. The apparatus of claim of claim 13, wherein rupturing of the rupture element enables fluid communication between the low pressure chamber and a wellbore region so that the applied hydraulic pressure is able to move an actuation member of the first part.

16. A method of activating a tool in a wellbore, comprising:

providing an integrated hydraulic setting and hydrostatic setting mechanism that has a hydraulic setting part responsive to hydraulic pressure applied through a conduit, and a hydrostatic setting part responsive to hydrostatic pressure in the wellbore, wherein the hydraulic setting part and hydrostatic setting part are integrated as part of one device such that the hydraulic setting part and hydrostatic setting part are not part of different modules that are connected or coupled together; and activating an activatable element in the tool by activating the integrated hydraulic setting and hydrostatic setting mechanism using the hydraulic pressure or the hydrostatic pressure, wherein the hydrostatic setting part is responsive to the hydrostatic pressure to activate the activatable element while the hydraulic setting part remains deactivated.

17. The method of claim 16, further comprising:

activating the hydrostatic setting part by positioning the tool at a target depth in the wellbore and applying an incremental pressure in an annulus region of the wellbore outside the tool to cause a pressure in the wellbore to exceed a pressure of a low pressure chamber in the hydrostatic setting part.

18. The method of claim 17, further comprising:

activating the hydraulic setting part by applying the hydraulic pressure through the conduit into an inner bore of the integrated hydraulic setting and hydrostatic setting mechanism, wherein the applied hydraulic pressure exceeds the hydrostatic pressure of the wellbore by greater than a predefined amount to activate the hydraulic setting part.

19. The method of claim 18, wherein activating the hydraulic setting part comprises activating the hydraulic setting part even though fluid has leaked into the low pressure chamber of the hydrostatic setting part from the wellbore.

20. A method of activating a tool in a wellbore, comprising:

providing an integrated hydraulic setting and hydrostatic setting mechanism that has a hydraulic setting part responsive to hydraulic pressure applied through a conduit, and a hydrostatic setting part responsive to hydrostatic pressure in the wellbore;

activating an activatable element in the tool by activating the integrated hydraulic setting and hydrostatic setting mechanism using the hydraulic pressure or the hydrostatic pressure, wherein the hydrostatic setting part is responsive to the hydrostatic pressure to activate the activatable element while the hydraulic setting part remains deactivated;

activating the hydrostatic setting part by positioning the tool at a target depth in the wellbore and applying an incremental pressure in an annulus region of the wellbore outside the tool to cause a pressure in the wellbore to exceed a pressure of a low pressure chamber in the hydrostatic setting part;

activating the hydraulic setting part by applying the hydraulic pressure through the conduit into an inner bore of the integrated hydraulic setting and hydrostatic setting mechanism, wherein the applied hydraulic pressure exceeds the hydrostatic pressure of the wellbore by greater than a predefined amount to activate the hydraulic setting part;

wherein activating the hydraulic setting part comprises activating the hydraulic setting part even though fluid has leaked into the low pressure chamber of the hydrostatic setting part from the wellbore; and providing a rupture element having one side in fluid communication with the low pressure chamber and another side in fluid communication with the wellbore, wherein applying the hydraulic pressure causes an incompressible fluid in the low pressure chamber to rise in pressure to cause rupturing of the rupture element from inside the integrated hydraulic setting and hydrostatic setting mechanism out to the wellbore.

21. A system for use in a wellbore, comprising:

a carrier structure; and a tool having an activatable element and an integrated setting and hydrostatic setting mechanism, wherein the integrated hydraulic setting and hydrostatic setting mechanism comprises a first part responsive to hydraulic pressure applied through a conduit, and a second part responsive to hydrostatic pressure in the wellbore, wherein the first part and second part are integrated as part of one device such that the first and second parts are not part of different modules that are connected or coupled together, and wherein the activatable element is to be activated by the integrated hydraulic setting and hydrostatic setting mechanism, and wherein the second part is responsive to the hydrostatic pressure to activate the activatable element while the first part remains deactivated.

22. The system of claim 21, wherein the second part is a primary setting mechanism of the tool, and the first part is a backup setting mechanism of the tool.

23. The system of claim 22, wherein the second part is used to activate the tool if leakage in the first part results in failure of the first part.

* * * * *